US005899300A

United States Patent [19]

Miller et al.

[11] Patent Number: 5,899,300

[45] Date of Patent: May 4, 1999

[54] MOUNTING FOR AN ELEVATOR TRACTION MACHINE

[75] Inventors: William T. Miller, Simsbury, Conn.; Dwight G. Covey, Bloomington; Larry S. Anderson, Springville, both of Ind.

[73] Assignee: Otis Elevator Company, Farmington, Conn.

[21] Appl. No.: 08/781,949

[22] Filed: Dec. 20, 1996

[51] Int. Cl.[6] ..... B66B 11/08

[52] U.S. Cl. ..... 187/256; 187/266; 187/404

[58] Field of Search ..... 187/404, 406, 187/253, 256, 266

[56] References Cited

U.S. PATENT DOCUMENTS

| | | | |
|---|---|---|---|
| 823,720 | 6/1906 | Fullenlove | 187/404 |
| 1,301,924 | 4/1919 | Evangelist | 187/404 |
| 2,088,690 | 8/1937 | Crispen | 187/20 |
| 3,896,905 | 7/1975 | Solymos | 187/266 |
| 4,529,062 | 7/1985 | Lamprey | 187/404 |
| 4,773,507 | 9/1988 | Kratz | 187/256 |
| 4,830,146 | 5/1989 | Nakamura et al. | 187/253 |
| 5,035,300 | 7/1991 | Chapelain et al. | 187/266 |
| 5,490,578 | 2/1996 | Aulanko et al. | 187/266 |
| 5,725,074 | 3/1998 | Richter et al. | 187/406 |

FOREIGN PATENT DOCUMENTS

| | | | |
|---|---|---|---|
| 0539238 | 4/1993 | European Pat. Off. . | |
| 0686594 | 12/1995 | European Pat. Off. . | |
| 4-49190 | 2/1992 | Japan | 187/406 |
| 4-89787 | 3/1992 | Japan | 187/404 |

*Primary Examiner*—Karen M. Young
*Assistant Examiner*—Douglas Hess

[57] ABSTRACT

Mounting apparatus for a traction machine disposed in a hoistway includes a pair of beams that extend through the hoistway to the pit. One of the beams includes a mounting plate disposed at the top of the beam and to which the machine is fastened. The elevator car frame is engaged with guide rails that are functionally separate from the beams. In a particular embodiment, the guide rails are retained to the beams by clips. The clips retain and position the guide rail without subjecting the guide rails to the load of the traction machine.

9 Claims, 4 Drawing Sheets

MOUNTING FOR AN ELEVATOR TRACTION MACHINE

TECHNICAL FIELD

The present invention relates to traction drive elevators, and more particularly to mounting apparatus and methods for traction machines of such elevators.

BACKGROUND OF THE INVENTION

A typical traction elevator system includes a car and a counterweight connected by multiple ropes, with the ropes extending over a traction sheave. The traction sheave is rotationally driven by a machine. The machine is mounted in a machineroom located above the hoistway, i.e., at the top of the building. The machineroom also houses other elevator peripheral equipment, such as the governor, the controller, and the drive for the machine.

Eliminating the machineroom provides potential savings in the construction of the building. In linear induction motor (LIM) elevators, the machine is a linear motor in which the primary and secondary are disposed in the hoistway. In one configuration, the primary is integral to the counterweight and the secondary is a column that extends through the hoistway. In other configurations, the primary is integral to the car frame. In either configuration, the machine is disposed in the hoistway, and thereby the machineroom may be eliminated.

Another elevator system configuration that eliminates the machineroom uses a disc type motor. This motor is smaller in axial direction and, as a result, may be positioned in the hoistway. An example of such a configuration is shown in European Patent Application EP 0 688 735. This patent application discloses a disc type motor disposed adjacent to the travel path of the elevator car and mounted on either the car guide rails or the counterweight guide rails. According to the specification, the guide rails provide a convenient support for the machine. A drawback to this mounting method is that the guide rails are designed and machined to provide a guiding mechanism for the car and counterweight. Using them as a support for the machine may increase the manufacturing cost significantly. In addition, the location of the machine is constrained by the need to place the guide rails in specific locations.

The above art notwithstanding, scientists and engineers under the direction of Applicants' Assignee are working to develop improved methods and apparatus to mount traction machines.

DISCLOSURE OF THE INVENTION

According to the invention, an elevator system includes a traction machine mounted on a beam that is functionally separate from the guide mechanism for the elevator and that extends to the pit. As a result of this method of mounting, loads on the traction machine are transferred to the pit of the hoistway, and thereby to the foundation of the building. Functionally separating the mounting beam and the guide mechanism provides flexibility in the design and location of the mounting beam and the guide mechanism. In this way the mounting beam and the guide mechanism may be optimized for their particular functions.

In a particular embodiment, the beam is I-shaped in cross-section and includes a mounting plate disposed at the top of the beam. The traction machine is fastened to the mounting plate. The guide mechanism includes a pair of guide rails extending through the hoistway, one of which is positioned along a flange of the beam by a plurality of clips. In this way the guide rail is retained in the desired position but is not subject to the loads of the traction machine.

In a further embodiment, a second beam extends through the hoistway. The second beam provides a dead-end hitch for traction ropes, a second mounting plate for a governor, and means to position the other of the pair of guide rails. As a result of this configuration, the loading on the traction ropes is transferred through the second beam to the pit of the hoistway, and thereby to the foundation of the building.

In another particular embodiment, one of a pair of channels formed by the I-shaped beam includes a cover that extends from one flange to the opposite flange. The resulting covered channel may be used as a cableway for various cables and wires that extend through the hoistway. The cableway protects the hoistway cables from damage and facilitates installation and maintenance of the elevator system.

The foregoing and other objects, features and advantages of the present invention become more apparent in light of the following detailed description of the exemplary embodiments thereof, as illustrated in the accompanying drawings.

BEST MODE FOR CARRYING OUT THE INVENTION

Figure 1:
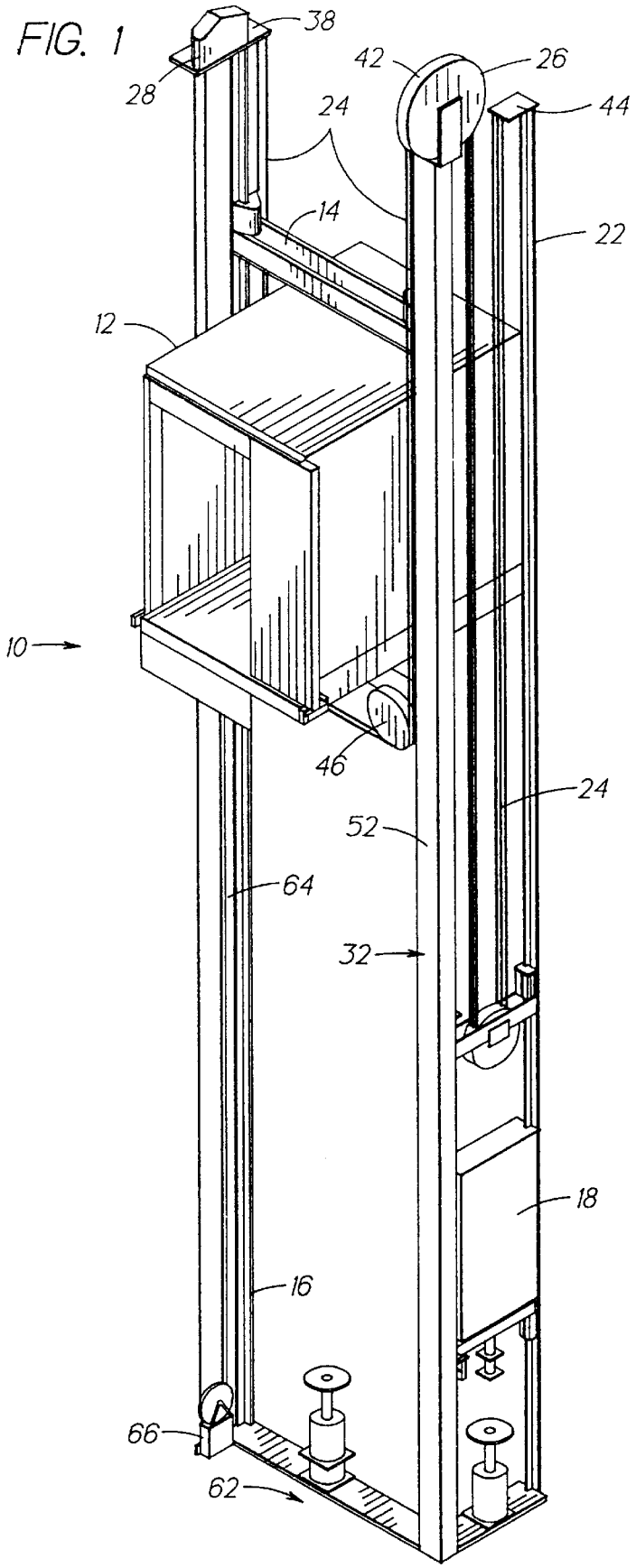
FIG. 1 is a perspective view of an elevator system.

Illustrated in FIG. 1 is an elevator system 10 having a car 12 mounted in a car frame 14, a pair of car guide rails 16, a counterweight 18, a pair of counterweight guide rails 22, a plurality of ropes 24, a traction machine 26, a governor 28 and a pair of mounting beams 32.

Figure 2:
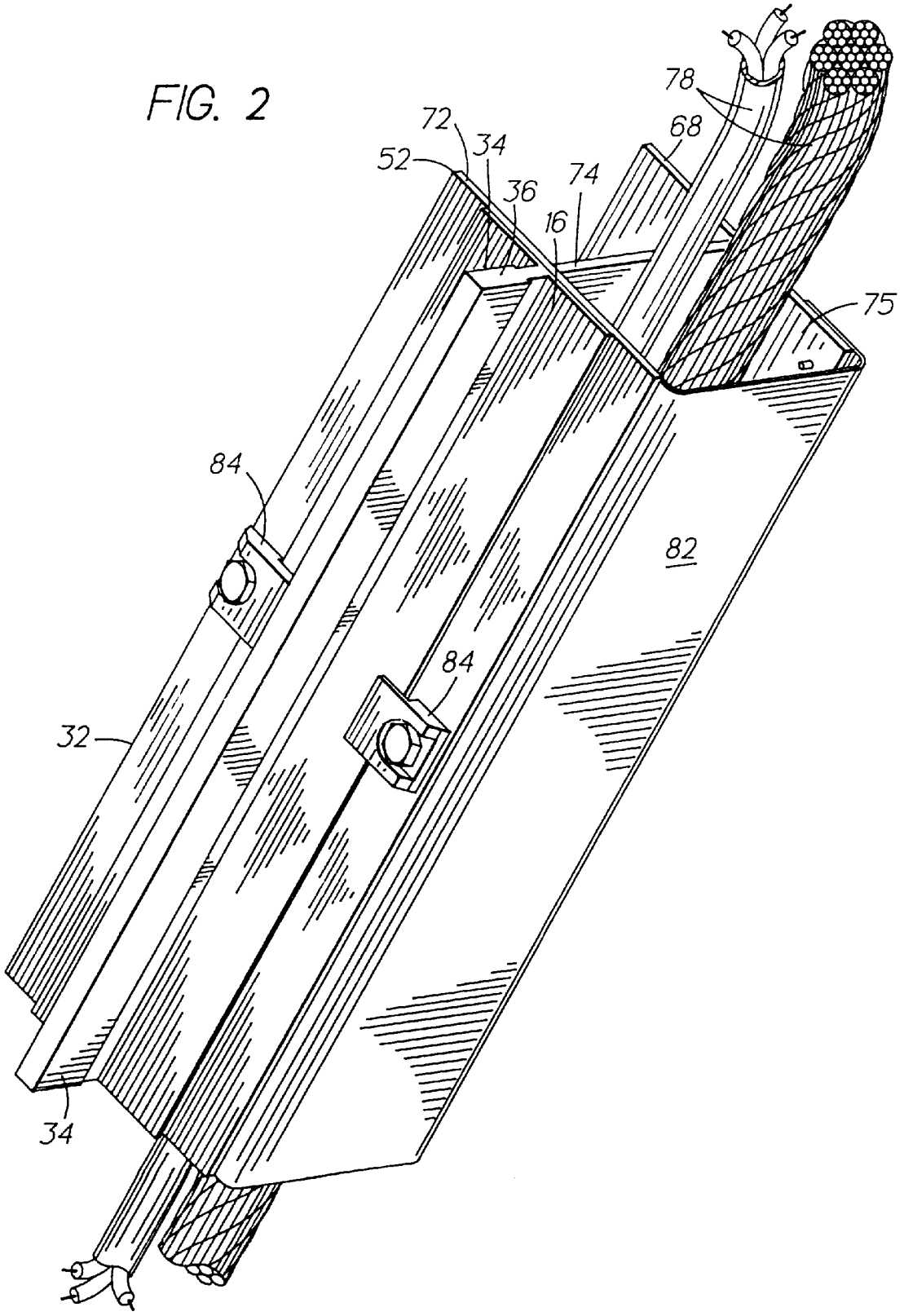
FIG. 2 is a sectioned, perspective view of a mounting beam.

The car frame 14 is engaged with the car guide rails 16 for movement through the hoistway (not shown). The guide rails 16 define a guide mechanism for the motion of the car 12. The guide rails 16, as shown more clearly in FIG. 2, are T-shaped and include contact surfaces 34 on one leg 36 of each guide rail 16. The car frame 14 include a conventional means to engage the contact surfaces 34, such as guide shoes or rollers.

The counterweight 18 is engaged with the counterweight guide rails 22 for movement through the hoistway. The counterweight guide rails 22 define a guide mechanism for the motion of the counterweight 18. As with the car guide rails 16, the counterweight guide rails 22 are T-shaped and include contact surfaces on one leg of each guide rail. The counterweight 18 includes a conventional means to engage the contact surfaces, such as guide shoes or rollers.

The plurality of ropes 24 are engaged with the car frame 14 and the counterweight 18. The ropes 24 extend down from a first dead-end hitch 38, underneath the car frame 14, back up and over a traction sheave 42, down to the counterweight 18 and back up to a second dead-end hitch 44. Engagement between the car frame 14 and the ropes 24 is via a pair of tandem car sheaves 46 disposed underneath the car frame 14. Engagement between the counterweight 18 and the ropes 24 is via a sheave 48 mounted on the counterweight 18. As a result, the configuration shown in FIG. 1 is a 2:2 roping. Although shown as such, it should be noted that the present invention may be used with other roping configurations.

Figure 3:
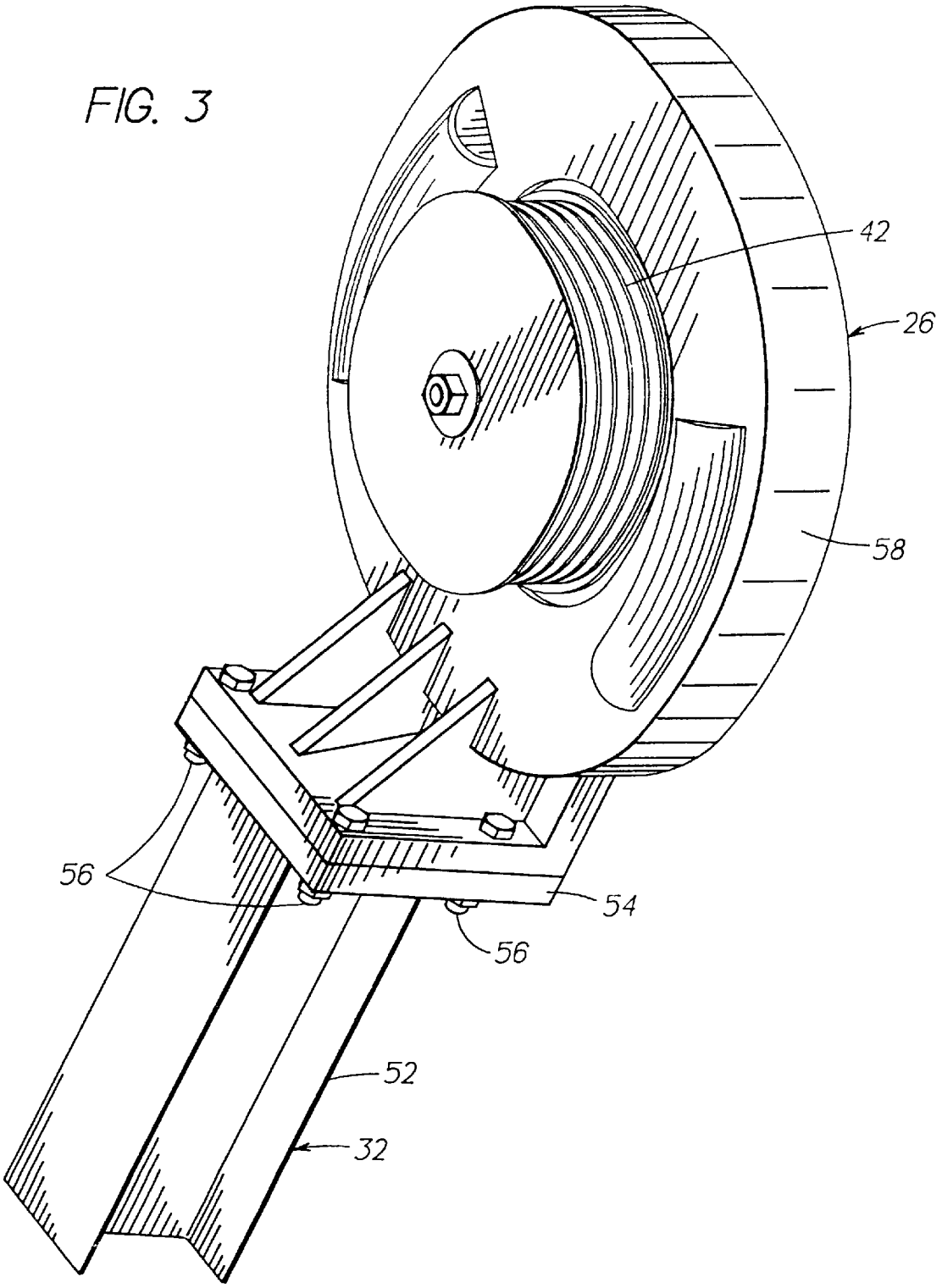
FIG. 3 is a perspective view of the mounting beam, a mounting plate, and a traction machine.

The pair of beams 32 extend through the hoistway on opposite sides of the car frame 14. The machine 26 is disposed at the top of one 52 of the pair of beams 32, as shown in FIG. 3. This beam 52 includes a mounting plate 54 to which the machine 26 is fixed by a plurality of fastening bolts 56. The machine 26, as shown illustratively in FIGS. 1 and 3, is a disc type electric motor 58 and includes the integral traction sheave 42. Rotation of the motor 58 causes the traction sheave 42 to rotate and drive the ropes 24.

Mounting the machine 26 on the beam 52 permits the machine 26 to be positioned within the hoistway, thereby eliminating the need for a machineroom. In addition, the beam 52 transfers the load of the machine 26 and the load from the engagement between the traction sheave 42 and the ropes 24 directly to the pit 62 of the hoistway. As a result, the machine 26 may be positioned at the top of the hoistway and the loads may be carried by the foundation of the building that houses the elevator system 10.

The other beam 64 is used to conveniently mount the governor 28 and its associated tension frame 66, and provides a termination point to fix the dead-end hitch 38 for the ropes 24. By fixing the dead-end hitch 38 to the beam 64, the loads from the ropes 24 are transferred through the dead-end hitch 38 to the beam 64, and thereby to the pit 62 of the hoistway and foundation of the building. This permits more of the elevator 10 loads to be transferred directly to the foundation using the beams 32 as conduits for the loads.

Each of the beams 32 is a structural stress, I-shaped structure, as shown more clearly in FIG. 2, and includes a pair of flanges 68,72 and a cross-member 74. A benefit of using such an I-beam as the mounting beam is that such structures are readily available, are relatively inexpensive, and have well known strength characteristics. Other structural members having different configurations and formed from different materials, however, may also be used to support the traction machine 26 and elevator 10 loads. In addition, each beam 32 may be a single, integral member as shown, or may be formed from a plurality of segments joined end-to-end to extend through the hoistway.

In addition to being a support structure for the machine 26, the beam 52 also includes a channel 75 that defines a cableway for the various electrical cables and wires 78 that run through the hoistway. To protect the cables 78 from damage, a cover 82 is placed over the cableway 76. This cover 82 extends from one flange 68 to the opposite flange 72 of the beam 72. The cableway 76 provides a convenient storage area for the cables 78 to facilitate installation and maintenance of the elevator system 10.

The car guide rails 16 are retained to the beams 32 as shown in FIG. 2. The retention means for the guide rails 16 includes a plurality of clips 84 that are fastened to one of the flanges 68 of the beam 52. The clips 84 retain the guide rails 16 without placing the loads from the machine 26 and traction sheave 42 onto the guide rails 16. As a result, the guide rails 16 are functionally separate from the beam 52 and the guide rails 16 may be designed and optimized for their function as a guiding mechanism.

Figure 4:
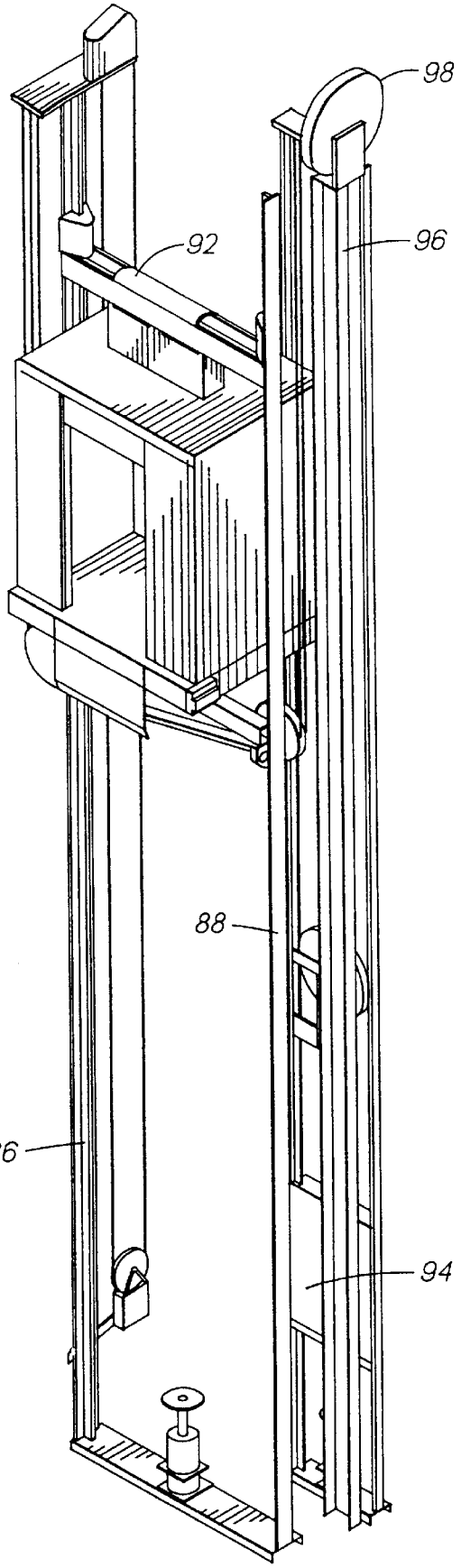
FIG. 4 is a perspective view of an elevator system, showing an alternate configuration of a mounting beam and guide mechanism.

Although shown in FIGS. 1–3 as having the guide rails 16 attached to the beams 32, it should be apparent to one skilled in the art that the guide rails 16 and beams 32 could be configured differently without departing from the spirit of the invention. An alternate embodiment of the present invention is illustrated in FIG. 4. In this configuration, guide rails 86,88 for both the car frame 92 and for the counterweight 94 are detached from the beam 96. The guide rails 86,88 are mounted in a conventional fashion to the walls of the hoistway. In this configuration, the beams 96 provide support for the traction machine 98, but are not used to retain and position the guide rails 86,88. This particular configuration provides flexibility in the location of the beams 96 and guide rails 86,88.

Although the invention has been shown and described with respect to exemplary embodiments thereof, it should be understood by those skilled in the art that various changes, omissions, and additions may be made thereto, without departing from the spirit and scope of the invention.

What is claimed is:

1. An elevator system having a car moving through a hoistway having a pit, the car being disposed in an opposing motion relationship to a counterweight by a rope, the elevator system including:

a guide mechanism that defines the path of the car through the hoistway;

a traction machine disposed in the hoistway and engaged with the rope to drive the car and the counterweight through the hoistway; and a beam extending to the pit of the hoistway, the beam being functionally separate from the guide mechanism, and wherein the traction machine is mounted on the beam such that the loads on the traction machine are transferred through the beam to the pit of the hoistway.

2. The elevator system according to claim 1, wherein the beam further includes a channel that defines a cableway for routing electrical cabling from the traction machine through the hoistway.

3. The elevator system according to claim 2, wherein the beam is an I-beam having a first flange and a second flange, the beam further including a cover that extends from the first flange to the second flange to define the cableway.

4. The elevator system according to claim 1, wherein the guide mechanism includes a pair of guide rails extending through the hoistway, each of the guide rails engaged with the car, and wherein one of the pair of guide rails is secured to the beam.

5. The elevator system according to claim 1, wherein the beam further includes a mounting plate disposed on the upper end of the beam, and wherein the traction machine is disposed on the mounting plate.

6. The elevator system according to claim 1, wherein the traction machine is disposed at the top of the hoistway and adjacent to the path of the car.

7. The elevator system according to claim 1, further including a pair of sheaves disposed on the underside of the car and engaged with the rope, and wherein the rope extends from the pair of sheaves to a fixed point in the hoistway.

8. The elevator system according to claim 1, further including a second beam extending to the pit of the hoistway, and wherein the rope is fixed to the second beam such that loads on the rope are transferred to the pit.

9. The elevator system according to claim 1, wherein the guide mechanism includes a pair of guide rails extending through the hoistway, each of the guide rails engaged with the car, and wherein each of the pair of guide rails is secured to one of the beams.

* * * * *